United States Patent [19]

Ciarlei et al.

[11] 4,391,322

[45] Jul. 5, 1983

[54] WIRE GUIDE FOR USE WITH A HEAT EXCHANGE UNIT

[75] Inventors: Joseph A. Ciarlei, Brewerton; Curtis L. Tobin, Chittenango; William B. Jennings, Clay, all of N.Y.

[73] Assignee: Carrier Corporation, Syracuse, N.Y.

[21] Appl. No.: 202,980

[22] Filed: Nov. 3, 1980

[51] Int. Cl.[3] ..... F28F 13/12

[52] U.S. Cl. ..... 165/125; 62/508

[58] Field of Search ..... 165/125; 62/507–508, 62/262, 298

[56] References Cited

U.S. PATENT DOCUMENTS 4,036,292 7/1977 Hine, Jr. ..... 62/507 X

*Primary Examiner*—Sheldon J. Richter

*Attorney, Agent, or Firm*—Donald F. Daley; Robert P. Hayter

[57] ABSTRACT

A wire guide assembly for use in an air conditioning system having a heat exchange unit. A wire guide assembly acts to provide a secure cavity through which wires emanating from the control area and flowing to a separately located electrical component may pass. The wire guide assembly serves to protect the wires from engagement with either a rotating fan or a heat exchanger. The wire guide assembly includes a control area member having a T-shaped opening, a retainer and a cover slidably engaged to the retainer.

6 Claims, 2 Drawing Figures

WIRE GUIDE FOR USE WITH A HEAT EXCHANGE UNIT

BACKGROUND OF THE INVENTION

1. Field of the Invention

This invention relates to heat exchange units for use in an air conditioning system. Particularly, this invention relates to a wire guide utilized in combination with a fan orifice defining a controls area for directing and protecting electrical wires passing from the control area over and around the heat exchanger and fan of the unit.

2. Description of the Prior Art

Air conditioning systems for conditioning residences and other interior spaces frequently utilize a combination of components such that the condenser unit of an air conditioning system is located outside of the residence and the evaporator unit of the system is located in communication with the interior space to be cooled. In a heat pump application the system might have an outdoor heat exchanger located about the enclosure and an interior heat exchange unit in communication with the interior space to be conditioned. These systems further utilize a compressor and appropriate expansion valves and piping such that heat energy may be transferred either to the region to be heated or from the region to be cooled. Each outdoor unit has an electric motor and fan associated therewith such that the outdoor air may be drawn through the heat exchanger of the unit. This air typically flows through a grille upon either entering the unit or being discharged from the unit. A conventional heat exchange unit includes a controls area wherein various electrical components may be mounted. To conform with Underwriters Laboratories safety requirements, this controls area is usually a segregated contained area defined by various sheet metal members. Electrical components such as relays, wiring terminals, transformers, printed circuit boards, capacitors and other electrical components are located within such an area. From this area electrical wires extend to components of the heat exchange unit which are located remote therefrom and which require electrical power for operation, condition sensing or performing some other function. In many outdoor heat exchange units a compressor and fan motor both require electrical connections to the control box area.

The present invention relates to a heat exchange unit wherein the heat exchanger extends circumferentially about the unit and the compressor is located with the heat exchanger at the bottom of the unit. The controls area of the unit is mounted at the top of the unit between the fan orifice and the exterior of the unit. For power wiring to the compressor or for other wiring to other components located within the unit such as a reversing valve in a heat pump, a pressure sensor or other valve or sensing device it is necessary that electrical wire extend from the controls area across and around the heat exchanger and between the heat exchanger and the fan. To protect the wiring from wear against a rough heat exchange surface or from contact with a rotating fan as well as to secure the integrity and prevent electrical shock this wire guide has been developed.

SUMMARY OF THE INVENTION

An object of the present invention is to provide a wire guide.

A more specific object of the present invention is to provide a wire guide to be utilized in an air conditioning unit for conducting electrical wires between the heat exchanger and a rotating fan.

A further object of the present invention is to provide a wire guide capable of meeting various safety requirements without being unduly expensive or burdensome to assemble.

Another object of the present invention is to provide a wire guide which is easy to manufacture, economical and easy to assemble and simple to maintain.

Other objects will be apparent from the description to follow and from the appended claims.

The foregoing objects are achieved according to a preferred embodiment of the invention by providing an outdoor heat exchange unit having a controls area located above the heat exchanger and outboard of the fan and compressor. The controls area has a T-shaped opening located at the bottom thereof. A retainer having a retainer back wall, two retainer side walls and two retainer rails formed generally in the shape of a U-shaped channel with outwardly extending rails may be slidably engaged into the narrower portion of the T-shaped opening. The retainer may additionally have flanges for securing it to the member defining the opening. A cover having a cover top surface for providing a wire securing cavity between the cover and the retainer and additionally having cover hook flanges located on each side thereof for engaging the retainer rails to provide slidable fastening therebetween is disclosed. The cover may be engaged to the retainer by sliding same through the wider portion of the T-shaped opening to engage the retainer. This combination of retainer, cover and opening through the controls area defining member provides a secure wire carrying cavity such that contact with either the heat exchanger of the heat exchange unit or a rotating fan is prevented.

DESCRIPTION OF THE PREFERRED EMBODIMENT

The embodiment of the invention described below will be in reference to an outdoor heat exchanger unit which includes an enclosure for a heat exchanger, a circumferentially extending heat exchanger mounted to a base pan and other various components. It is to be understood that this device finds like applicability to other types of heat exchange units and in general to other applications where it is necessary to guide wires between potential obstacles. The specific details as to fastening and engagement are enumerated herein and it is to be understood that equivalent fastening methods may be utilized.

Figure 1:
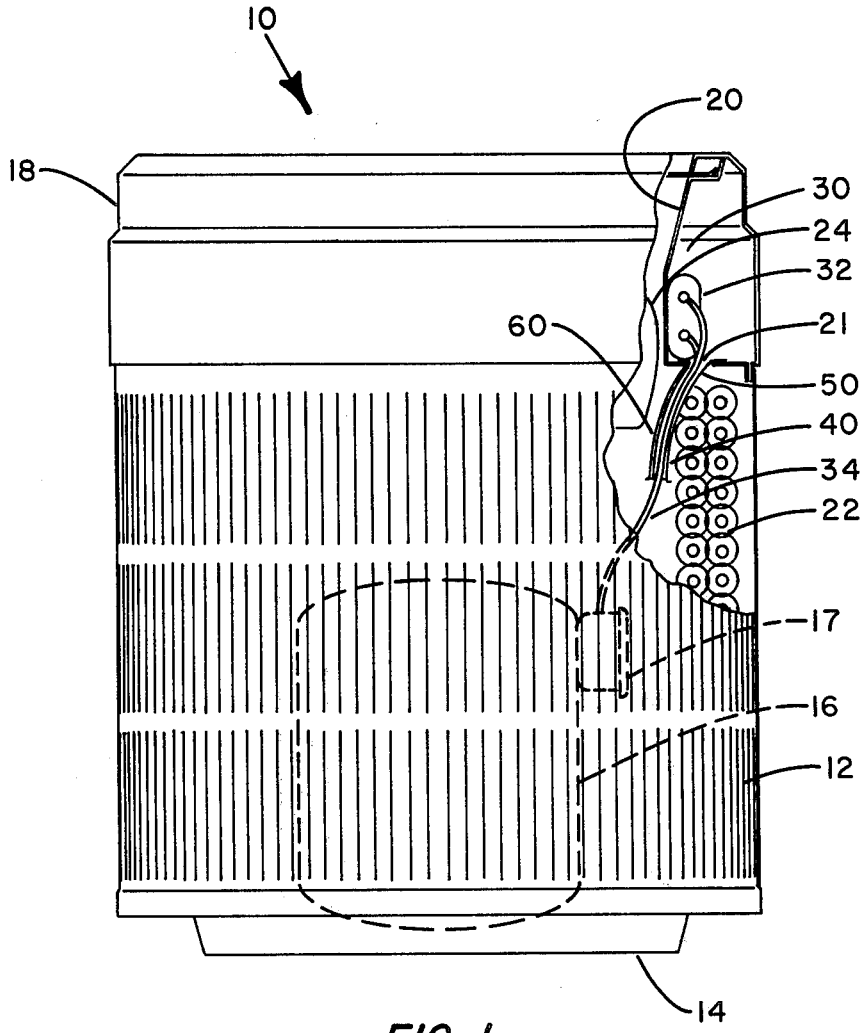
FIG. 1 is a partially cut away side view of the heat exchange unit.

Referring now to the drawings it can be seen in FIG. 1 that heat exchange unit 10 has base pan 14 upon which the remainder of the components are assembled. Mounted to the base pan 14 is compressor 16 having compressor terminal block 17 extending from the side thereof. Additionally mounted to base pan 14 is heat exchanger 22 which is cylindrical in configuration extending about the circumference of the unit. Wrapper 12 is mounted to cover the heat exchanger for protecting the heat exchanger and to provide a neat appearance for the unit. Other components having electrical connection requirements such as reversing valves and sensors may also be located within the center void defined by heat exchanger 22.

Mounted above the heat exchanger 22 is fan orifice 20 and top cover 18. Fan orifice 20 acts to define an air flow path out the top of the unit such that air circulated by fan 24 is drawn into the unit through wrapper 12, passes through heat exchanger 22 and is discharged out the top of the unit. The fan orifice in combination with the top cover defines a controls area 30 into which control components 32 are mounted. Wire guide 40, including retainer 50 and cover 60, is shown extending through wire guide opening 21 in the bottom of the fan orifice such that wire 34 connecting one of the control components 32 to compressor terminal 17 or other electrical devices is secured therein. It can be seen that the wire guide extends around and across a portion of heat exchanger 22 and to a point below fan 24 such that contact with either the fan or the heat exchanger by the wire is prevented.

Figure 2:
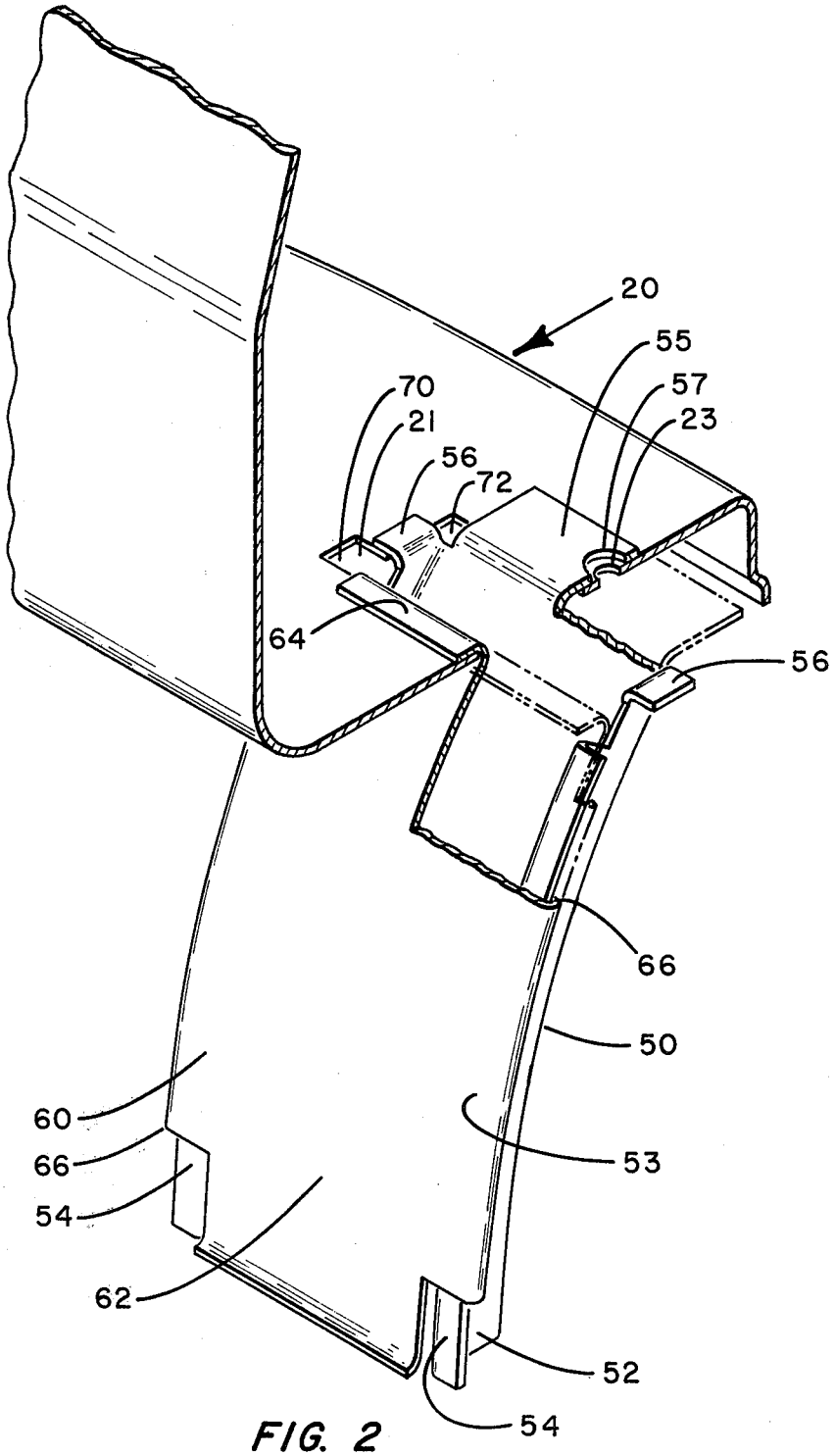
FIG. 2 is a partial view of the apparatus incorporated in the invention showing the member having a T-shaped opening, the retainer and the cover.

In FIG. 2, the details of the wire guide are more specifically shown. Fan orifice 20 is shown cut away with fan wire guide opening 21 shown therein. Wire guide opening 21 is shown in a T-shaped configuration having narrow portion 72 and wide portion 70. Retainer 50 is shown in the general form of a U-shaped channel having rails extending therefrom. Retainer 50 has retainer back wall 53 and secured one to each edge of the retainer back wall are retainer side walls 52 extending upwardly therefrom. At the outer edges of retainer side wall 52 are retainer rails 54 extending outwardly from the retainer side walls in a plane generally parallel to the plane of retainer back wall 53. Additionally, the retainer has retainer side flanges 56 extending outwardly at the top of the retainer to engage the fan orifice 20 and retainer back flange 55 likewise extending to engage fan orifice 20 for securing the retainer thereto. Additionally, screw opening 57 is shown through the retainer back flange, said screw opening mating with fan orifice screw hole 23 such that a screw may secure the two components together.

Cover 60 shown being a generally planar member adapted to cover the opening between the retainer side walls 52 and retainer back wall 53 to form the wire securing cavity between the cover and retainer. Cover 60 has hook flanges 66 on each edge thereof. These flanges are U-shaped portions adapted to have the retainer rail 54 contained within the hook flange such that a slidable engagement between them is created. The cover additionally has a cover top flange 64 for engaging the fan orifice to hold the cover in position.

Upon assembly of the unit, the retainer may be slid into the narrow portion of the T-shaped opening such that the side flange and back flange engage the fan orifice. The retainer rails extend into the wide portion of opening 70 since they are flared outwardly extending a greater width than the retainer side walls 52.

After insertion of the retainer through the wire guide opening 21, cover 60 may be placed in position such that the hook flanges engage the retainer rails and thereafter is slid along the rails as it is inserted into the opening. The hook flanges engage the side rails to secure the cover to the container and upon being fully inserted cover top flange 64 engages the fan orifice 20 to limit further motion therebetween. A fully enclosed wire retaining cavity is formed such that any wires therein may be protected against contact from the heat exchanger or the fan. Wires may be inserted into the opening prior to the final assembly of the cover or thereafter. A screw may be inserted through screw opening 57 into the fan orifice to secure the retainer to the fan orifice.

The invention has been described in detail with particular reference to a preferred embodiment thereof but it will be understood thar variations and modifications can be effected within the spirit and scope of the invention.

What is claimed is:

1. A heat exchange unit comprising:

support means for supporting the unit;

a heat exchanger mounted to the support means and extending about at least a portion of the periphery of the unit;

a fan for circulating air in heat exchange relation with the heat exchanger;

means defining a control area circumferentially spaced about the fan and adjacent the heat exchanger wherein at least one electrical component of the heat exchange unit may be mounted, said means additionally defining a wire guide opening; and a wire guide connected to extend through the wire guide opening and between the fan and the heat exchanger, said wire guide defining a wire securing cavity and including means for connecting the wire guide to the means defining the control area.

2. The apparatus as set forth in claim 1 wherein the wire guide comprises a retainer in a U-shaped configuration and a cover adapted to be secured to the retainer to form the wire securing cavity.

3. The apparatus as set forth in claim 2 wherein the means defining the control area comprises a fan orifice annular in configuration having a U-shaped cross section within which the control area is located, and further comprising a fan mounted to revolve within the fan orifice and wherein the wire guide extends from an opening in the fan orifice between the fan and the heat exchanger.

4. The apparatus as set forth in claim 1 wherein the wire guide comprises a retainer having a retainer back wall, two retainer side walls attached to each edge of the retainer back wall, a fastening flange attached to the retainer back wall for securing the retainer to the means defining a control area and a cover adapted to be secured to the two retainer side walls to form the wire securing cavity between the cover and the retainer.

5. The apparatus as set forth in claim 4 wherein each retainer side wall has extending therefrom a retainer rail which is generally planar with the retainer back wall and wherein the cover includes a cover hook flange on each edge thereof, said cover hook flanges engaging the retainer rails to slidably secure the retainer to the cover.

6. The apparatus as set forth in claim 5 wherein the wire guide opening has a narrow portion through which the cover is inserted and connected to the narrow portion a wide portion through which the retainer with the retainer hook flanges may be inserted.

* * * * *